US010624180B1

(12) United States Patent
Shen

(10) Patent No.: US 10,624,180 B1
(45) **Date of Patent: *Apr. 14, 2020**

(54) USB-POWERED LAMP STRIP CONTROLLER

(71) Applicant: NINGBO GOLDEN POWER ELECTRONIC CO., LTD., Ningbo (CN)

(72) Inventor: Zhengxian Shen, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/354,610

(22) Filed: Mar. 15, 2019

(30) Foreign Application Priority Data

Nov. 23, 2018 (CN) ..... 2018 2 1940232 U

(51) Int. Cl.
*H05B 37/02* (2006.01)
*H05B 33/08* (2020.01)

(52) U.S. Cl.
CPC ..... *H05B 37/0272* (2013.01); *H05B 33/0824* (2013.01); *H05B 33/0857* (2013.01)

(58) Field of Classification Search
None
See application file for complete search history.

(56) References Cited

U.S. PATENT DOCUMENTS 8,194,133 B2 * 6/2012 DeWind ..... B60K 35/00 348/148
8,908,039 B2 * 12/2014 De Wind ..... B60K 35/00 348/148
9,783,114 B2 * 10/2017 De Wind ..... B60K 35/00
9,839,103 B2 * 12/2017 Avrahamy ..... C02F 1/42
9,867,263 B2 * 1/2018 Avrahamy ..... H05B 39/086
2007/0132315 A1 * 6/2007 Wang ..... G06F 1/26 307/18
2008/0266389 A1 * 10/2008 DeWind ..... B60K 35/00 348/115
2010/0311494 A1 * 12/2010 Miller ..... A63F 1/18 463/22
2012/0013257 A1 * 1/2012 Sibert ..... H05B 37/0245 315/152
2012/0236152 A1 * 9/2012 De Wind ..... B60K 35/00 348/148
2012/0306435 A1 * 12/2012 Tu ..... H02J 7/0052 320/107
2015/0146000 A1 * 5/2015 De Wind ..... B60K 35/00 348/148

(Continued)

*Primary Examiner* — Alexander H Taningco
*Assistant Examiner* — Srinivas Sathiraju
(74) *Attorney, Agent, or Firm* — W&K IP

(57) ABSTRACT

The present disclosure relates to a USB-powered lamp strip controller which comprises a USB port for connecting the controller to a power source to supply power to the controller; an infrared receiving unit electrically connected to the USB port for receiving an infrared signal transmitted by an external infrared terminal; a control unit electrically connected to the USB port and the infrared receiving unit for receiving the infrared signal and issuing a control signal according to the infrared signal; a driving unit electrically connected to the control unit to adjust a flicker color and a flicker frequency of the lamp strip according to the control signal; and a manual control unit disposed between the USB port and the control unit for inputting a manual signal to the control unit such that the driving unit drives the lamp strip to display a plurality of modes.

7 Claims, 2 Drawing Sheets

(56) References Cited

U.S. PATENT DOCUMENTS

| | | | | |
|---|---|---|---|---|
| 2016/0099596 | A1* | 4/2016 | Chien | H02J 7/0052 368/10 |
| 2016/0153650 | A1* | 6/2016 | Chien | F21V 33/0004 362/253 |
| 2017/0086281 | A1* | 3/2017 | Avrahamy | C02F 1/42 |
| 2017/0159929 | A1* | 6/2017 | Li | F21V 33/0024 |
| 2017/0265287 | A1* | 9/2017 | Avrahamy | C02F 1/42 |
| 2019/0215923 | A1* | 7/2019 | Shen | H05B 33/0842 |

* cited by examiner

USB-POWERED LAMP STRIP CONTROLLER

CROSS-REFERENCE TO RELATED APPLICATIONS

This application claims priority to Chinese Patent Application No. 201821940232.5 with a filing date of Nov. 23, 2018. The content of the aforementioned application, including any intervening amendments thereto, are incorporated herein by reference.

TECHNICAL FIELD

The present disclosure relates to the field of controllers, and more particularly, to a USB-powered lamp strip controller.

BACKGROUND

In recent years, lighting equipment for LED light sources has been constantly increasing. Correspondingly, more controllers for LED strips become known in the art. In practical applications, LED strips are often powered by an AC power port. However, as USB ports are becoming more widely used in daily lives, a problem as to how to combine the USB port with the lamp strip controller to supply power to the LED lamp strip has risen to be solved.

SUMMARY

The present disclosure discloses a USB-powered lamp strip controller which comprises a USB port for connecting the controller to a power source to supply power to the controller; an infrared receiving unit electrically connected to the USB port for receiving an infrared signal transmitted by an external infrared terminal; a control unit electrically connected to the USB port and the infrared receiving unit for receiving the infrared signal and issuing a control signal according to the infrared signal; a driving unit electrically connected to the control unit to adjust a flicker color and a flicker frequency of the lamp strip according to the control signal; and a manual control unit disposed between the USB port and the control unit for inputting a manual signal to the control unit such that the driving unit drives the lamp strip to display a plurality of modes. The driving unit is composed of a first transistor Q1, a second transistor Q2, a third transistor Q3, and a fourth transistor Q4. The output pins of two output control signals of the control unit are respectively connected to the base or gate of the third transistor Q3 and the fourth transistor Q4. The emitter or source of the third transistor Q3 and the fourth transistor Q4 are grounded. The collector or drain of the third transistor Q3 and the fourth transistor Q4 are connected as an output terminal to the lamp strip. The emitter or source of the first transistor Q1 and the second transistor Q2 are connected to the USB port. The base or gate of the first transistor Q1 is connected to the collector or drain of the fourth transistor Q4 and the second transistor Q2, and the base or gate of the second transistor Q2 is connected to the collector or drain of the third transistor Q3 and the first transistor Q1.

In the above-mentioned USB-powered lamp strip controller, the power supply for the controller and the power source is enabled by the USB port. With the USB port, users can conveniently select a corresponding USB port of various appliances as the power source according to their needs.

In an embodiment, the control unit is composed of a control chip U1, the infrared receiving unit is composed of an infrared receiving chip, an input pin of the control chip U1 is electrically connected to the USB port, and a signal input pin of the control chip U1 is electrically connected to an output pin of the infrared receiving chip.

In an embodiment, the control chip U1 is further electrically coupled to a crystal oscillator circuit.

In an embodiment, the manual control unit includes a button SW1 having one end connected to a manual signal input pin of the control chip U1 and the other end grounded. This setting realizes the combination of manual and automatic means, and prevents the user from starting or switching the modes of the lamp strip when the infrared receiving functionality is malfunctioning.

In an embodiment, the manual signal input pin of the control chip U1 is further connected to the USB port through an LED and a resistor R7, and the diode LED and the resistor R7 are connected in series.

In an embodiment, the emitters of the third transistor Q3 and the fourth transistor Q4 are grounded via a resistor R8.

In an embodiment, the transistor is a triode or a MOS transistor.

The above technical solution has the following advantages: In the USB-powered lamp strip controller described above, it is possible to drive the lamp strip and control the light-emitting modes by using the USB port. The USB port has a wide range of application in daily lives, and various types of small power supplies and even sockets may be provided with a USB port. The controller enables the user to directly control the lamp strip by a USB socket according to his or her actual needs, so it is more user-friendly and convenient.

BRIEF DESCRIPTION OF THE DRAWINGS

Embodiments of the present disclosure are described more fully with reference to the accompanying drawings. The drawings are, however, to be construed as illustrative and not restriction.

Reference Labels: 1, USB port; 2, infrared receiving unit; 3, control unit; 4, driving unit; 5, manual control unit; 21, housing, 22, power converter, 23 controller.

BRIEF DESCRIPTION OF THE DRAWINGS

The concept of the present disclosure will be described below using terms commonly used by those skilled in the art to convey the substance of their work to others skilled in the art. However, these concepts of the disclosure may be embodied in many different forms and should not be construed as limited to the embodiments described herein. These embodiments are provided to make the disclosure more complete and thorough, and to fully convey the scope of the disclosure to those skilled in the art. It should also be noted that these embodiments are not mutually exclusive. Components, steps or elements from one embodiment may be assumed to exist or be used in another embodiment. The particular embodiments shown and described may be substituted for a variety of alternatives and/or equivalent implementations without departing from the scope of the embodiments of the present disclosure. This application is intended to cover any adaptations or variations of the embodiments discussed herein. It will be apparent to those skilled in the art that the alternative embodiments may be practiced using only some of the described aspects. The specific figures, materials, and configurations are described herein for purposes of illustration, and may be practiced by those skilled in the art without the specific details. In other instances, well-known features may be omitted or simplified so as not to obscure the illustrative embodiments.

Moreover, the terms "first," "second," and "third" are used for descriptive purposes only and are not to be construed as indicating or implying relative importance. Unless specifically stated and limited, the terms "provided", "mounted", "connected", and "coupled" are to be understood broadly, and may be, for example, a fixed connection, a detachable connection, or an integral connection; it can be a mechanical connection or an electrical connection; it can be directly connected or indirectly connected through an intermediate medium, which can be the internal connection of the two elements. The term "fixing" may be welding or screwing or snapping. The specific meanings of the above terms in the present disclosure can be understood by those skilled in the art in specific cases.

The USB-powered lamp strip controller according to the present disclosure would be described hereinafter in conjunction with the accompanying drawings and embodiments.

Figure 1:
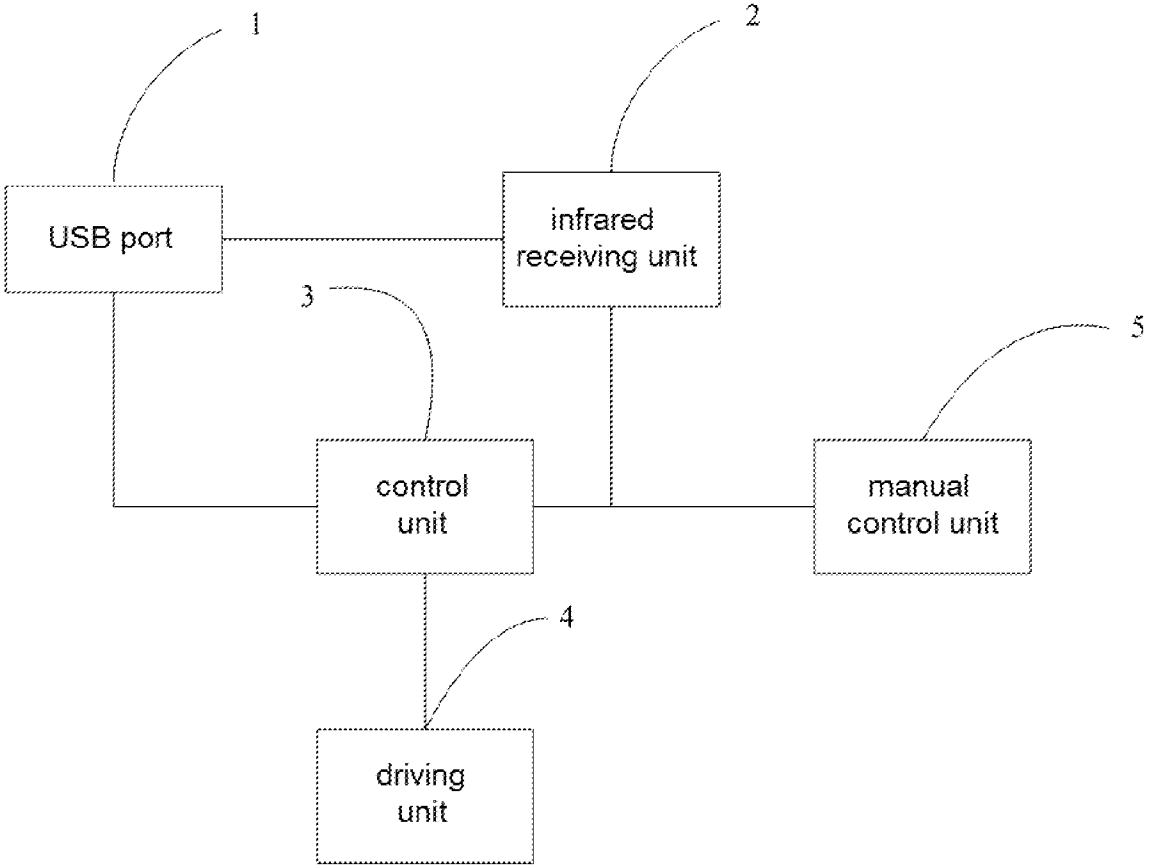
FIG. 1 is a structural block diagram of a USB-powered lamp strip controller according to an embodiment.

As shown in FIG. 1, a USB-powered lamp strip controller is disposed between a power source and a lamp strip. The controller comprises:

a USB port 1 for connecting the controller to a power source to supply power to the controller;

an infrared receiving unit 2 electrically connected to the USB port 1 for receiving an infrared signal transmitted by an external infrared terminal;

a control unit 3 electrically connected to the USB port 1 and the infrared receiving unit 2 for receiving the infrared signal and issuing a control signal according to the infrared signal;

a driving unit 4 electrically connected to the control unit 3 to adjust a flicker color and a flicker frequency of the lamp strip according to the control signal; and a manual control unit 5 disposed between the USB port 1 and the control unit 3 for inputting a manual signal to the control unit 3 such that the driving unit 4 drives the lamp strip to display a plurality of modes;

In the USB-powered lamp strip controller described above, firstly the USB port 1 is used to implement power supply between the controller and the power source. With USB port 1, users can select a corresponding USB port of various appliances as the power supply according to their needs. In addition, when the infrared receiving unit 2 receives an infrared signal transmitted from an external infrared terminal, the signal is forwarded to the control unit 3, and the control unit 3 processes the infrared signal to output a control signal to the driving unit 4. The driving unit 4 changes the magnitude and frequency of the output voltage according to the control signal to adjust the flicker color and flicker frequency of the strip. It is worth noting that a manual control unit 5 is also provided in the controller. The manual control unit 5 is disposed between the USB port 1 and the control unit 3. The user can also input a manual signal to the control unit 3 through the manual control unit 5. The control unit 3 inputs a corresponding control signal to the driving unit 4 according to the manual signal, and similarly change the magnitude and frequency of the output voltage of the driving unit 4, thereby adjusting the flicker color and the flicker frequency of the lamp strip.

Figure 2:
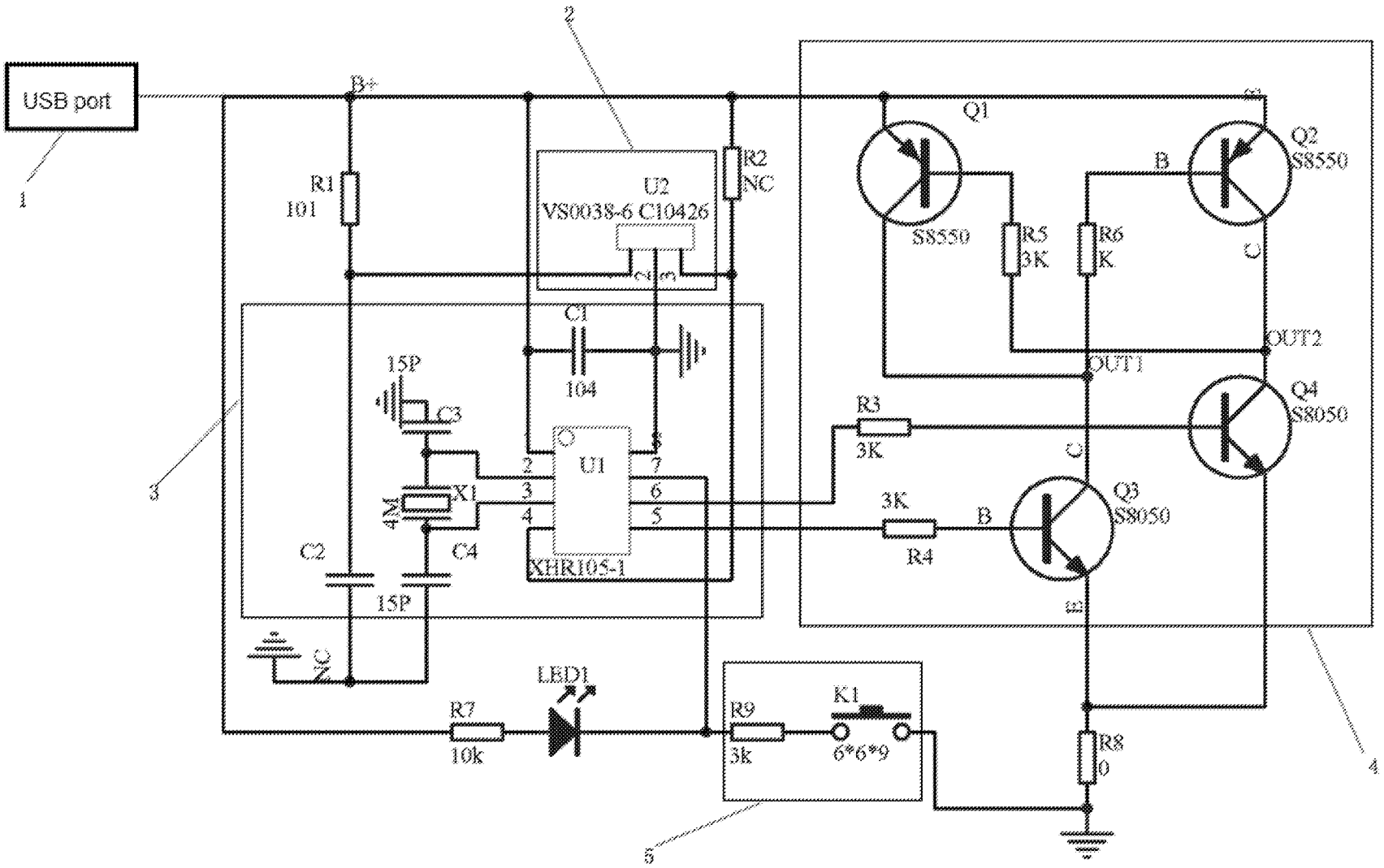
FIG. 2 is a circuit diagram of a USB-powered lamp strip controller according to an embodiment.

Further, as shown in FIG. 2, the control unit 3 is a control chip U1. The first pin (input pin) of the control chip is electrically connected to the USB port 1, and the fourth pin (signal input pin) of the control chip is connected to the output of the infrared receiving unit 2 to receive an infrared signal. Also, the sixth pin and the fifth pin (both being output pins) of the control chip U1 are electrically connected to the driving unit 4 to output a control signal to the driving unit 4.

Further, the infrared receiving unit 2 is composed of an infrared receiving chip. Preferably, the infrared receiving chip has a model number VS0038-6. The VCC pin (first pin) of the infrared receiving chip is connected to the USB port 1 via the resistor R1. The output pin (third pin) of the infrared receiving chip is connected to the fourth pin (signal input pin) of the control chip U1. After the infrared signal is received, the infrared signal is transmitted to the signal input pin of the control chip U1 through the output pin. In addition, the second pin of the infrared receiving chip is grounded, and the first pin of the infrared receiving chip is connected to the USB port 1 via the resistor R1.

Further, a crystal oscillator circuit may be disposed between the second pin and the third pin of the control chip U1, and the crystal oscillator circuit is composed of a Zener diode X1, a capacitor C3 and a capacitor C4. In addition, the resistor R1 is also grounded via the capacitor C2. A grounding capacitor C1 is provided between the first pin and the eighth pin.

Further, the manual control unit 5 includes a button SW1. One end of the button SW1 is connected to the seventh pin (manual signal input pin) of the control chip U1, and the other end is grounded. When the user presses the button SW1, each press would input one control signal to command the control chip U1 to change the voltages outputted from the sixth pin and the fifth pin, thereby adjusting the lamp strip or more specifically switching the modes of the lamp strip. In addition, the seventh pin of the control chip U1 is also connected to the USB port 1 through an LED and a resistor R7. When the controller enters a timing mode, the LED is illuminated to remind the user. Further, a resistor R9 is further connected in series between the button SW1 and the seventh pin.

Further, the driving unit 4 is composed of a plurality of transistors, and each transistor may be a triode or a MOS transistor. For example, four transistors Q1, Q2, Q3, Q4 can be included. The fifth pin and the sixth pin of the control chip U1 are respectively connected to the base or gate of the third triode or MOS transistor Q3 and the fourth triode or MOS transistor Q4. The emitter or source of the third triode or MOS transistor Q3 and the fourth triode or MOS transistor Q4 are grounded. The collector or the drain of the third triode or MOS transistor Q3 and the fourth triode or MOS transistor Q4 are connected to the lamp strip as the output end. When the fifth pin and the sixth pin output a control signal, the magnitude and frequency of the output voltage of the third triode or MOS transistor Q3 and the fourth triode or MOS transistor Q4 are changed, thereby adjusting the flicker color and the flicker frequency of the strip. It is worth noting that the emitters of the first triode or MOS transistor Q1 and the second triode or MOS transistor Q2 are connected to the USB port 1, and the base of the first triode or MOS transistor Q1 is connected to the collector of the fourth triode or MOS transistor Q4 and the collector of the second triode or MOS transistor Q2 through a resistor R5. The base of the second triode or MOS transistor Q2 is connected via a resistor R6 to a collector or drain of the third triode or MOS transistor Q3 and the first triode or MOS transistor Q1. In addition, the emitter or drain of the third triode or MOS transistor Q3 and the fourth triode or MOS transistor Q4 are grounded via a resistor R8. A resistor R4 is connected in series between the base or the gate of the third triode or MOS transistor Q3 and the fifth pin of the control chip U1, and a resistor R3 is connected in series between the sixth pin and the base or gate of the fourth triode or MOS transistor Q4.

After the above controller is powered on, a first mode would be displayed, and the flicker frequency is the lowest. Pressing the button shortly would switch the lamp strip to a second mode where the flicker frequency is higher. Pressing yet again would further increase the flicker frequency or turn the lamp strip into another flicker mode. Similarly, the eighth mode would keep the lights on constantly. For example, the infrared terminal is an XRP-1 (13-key) remote controller, and the remote controller can control various functions of the product including on/off, timing, the eight modes, and light tuning of four levels. In addition, a long press on the button after power-on controls product to turn on/off and switch on/off the timing. The flicker frequency of the lamp strip can be different in the eight modes, and the brightness of the lamp strip is different under the four levels of light-tuning. It is worth pointing out that when the illumination intensity of the lamp strip is gradually lowered and repeated repeatedly at a certain period or frequency, a breathing effect of the lamp strip is achieved. In addition, when the light strip is illuminated, one or more of the LED lights may suddenly increase in illumination intensity (significantly higher than other LED lights) to enter a jumper pattern. The jumper pattern can appear at a certain frequency. Further, according to the type of the control chip U1, the controller can be divided into two types: one with memory and one without memory. The first mode is displayed after power-on for the type with memory, and the last mode before power-off is displayed after power-on for the type without memory.

In the USB-powered lamp strip controller described above, it is possible to drive the lamp strip and control the light-emitting modes by using the USB port. The USB port has a wide range of application in daily lives, and various types of small power supplies and even sockets may be provided with a USB port. The controller enables the user to directly control the lamp strip by a USB socket according to his or her actual needs, so it is more user-friendly and convenient.

Various changes and modifications will no doubt become apparent to those skilled in the art. Accordingly, the appended claims are intended to cover all such modifications and changes. Any and all equivalents thereof are intended to be within the scope and spirit of the invention.

I claim:

1. A USB-powered lamp strip controller disposed between a power source and a lamp strip, wherein the controller comprises:

a USB port for connecting the controller to a power source to supply power to the controller;

an infrared receiving unit electrically connected to the USB port for receiving an infrared signal transmitted by an external infrared terminal;

a control unit electrically connected to the USB port and the infrared receiving unit for receiving the infrared signal and issuing a control signal according to the infrared signal;

a driving unit electrically connected to the control unit to adjust a flicker color and a flicker frequency of the lamp strip according to the control signal; and a manual control unit disposed between the USB port and the control unit for inputting a manual signal to the control unit such that the driving unit drives the lamp strip to display a plurality of modes; and wherein the driving unit is composed of a first transistor, a second transistor, a third transistor, and a fourth transistor;

the output pins of two output control signals of the control unit are respectively connected to the base or gate of the third transistor and the fourth transistor;

the emitter or source of the third transistor and the fourth transistor are grounded;

the collector or drain of the third transistor and the fourth transistor are connected as an output terminal to the lamp strip;

the emitter or source of the first transistor and the second transistor are connected to the USB port;

the base or gate of the first transistor is connected to the collector or drain of the fourth transistor and the second transistor; and the base or gate of the second transistor is connected to the collector or drain of the third transistor and the first transistor.

2. The USB-powered lamp strip controller according to claim 1, wherein the control unit is composed of a control chip, the infrared receiving unit is composed of an infrared receiving chip, an input pin of the control chip is electrically connected to the USB port, and a signal input pin of the control chip is electrically connected to an output pin of the infrared receiving chip.

3. The USB-powered lamp strip controller according to claim 2, wherein the control chip is further electrically coupled to a crystal oscillator circuit.

4. The USB-powered lamp strip controller according to claim 2, wherein the manual control unit includes a button having one end connected to a manual signal input pin of the control chip and the other end grounded.

5. The USB-powered lamp strip controller according to claim 4, wherein the manual signal input pin of the control chip is further connected to the USB port through an LED and a resistor, and the diode LED and the resistor are connected in series.

6. The USB-powered lamp strip controller according to claim 1, wherein the emitters of the third transistor and the fourth transistor are grounded via a resistor (R8).

7. The USB-powered lamp strip controller according to claim 1, wherein the transistor is a triode or a MOS transistor.

* * * * *